United States Patent [19]

Kinnison

[11] 4,015,672

[45] Apr. 5, 1977

[54] DIGGER ATTACHMENT

[76] Inventor: Daniel E. Kinnison, 119 E. 9th St., Kimball, Nebr. 69145

[22] Filed: July 7, 1975

[21] Appl. No.: 593,500

[52] U.S. Cl. ..... 173/160; 173/38

[51] Int. Cl.[2] ..... E21C 5/00

[58] Field of Search ..... 173/26, 38, 140, 160; 172/98; 212/8 R, 8 A

[56] References Cited

UNITED STATES PATENTS

| | | | |
|---|---|---|---|
| 1,622,704 | 3/1927 | Coil | 173/26 |
| 2,410,508 | 11/1946 | Lamme | 173/26 |
| 2,461,373 | 2/1949 | Cox | 173/38 |
| 2,581,535 | 1/1952 | Jackson | 173/38 |
| 2,812,162 | 11/1957 | Lay | 173/38 |
| 2,890,860 | 6/1959 | Smith | 173/26 X |

*Primary Examiner*—Ernest R. Purser
*Assistant Examiner*—Richard E. Favreau
*Attorney, Agent, or Firm*—LeBlanc & Shur

[57] ABSTRACT

Disclosed is a digger attachment for a tractor including a frame having at one end of a frame arm a three-point mount for securing the digger to the tractor. The opposite end of the frame arm supports an auger for pivotal movement about a transverse axis. Attached to the head of the auger is a shaft which extends through a bracket mounted on the frame arm. Coil springs are provided about the shaft on opposite sides of the bracket with the opposite ends of the springs butting against nuts threaded on the shaft. To utilize the digger, the nuts on the opposite ends of the shaft are threaded such that the springs displace the shaft in a manner displacing the auger about its transverse pivotal axis such that its rotational axis is slightly rearwardly inclined relative to a vertical through the auger's pivot. That is, the nuts are respectively threaded and unthreaded to achieve the desired inclination of the auger with the spring forces acting on the shaft in balance. Downward movement of the frame arm thus causes the rotational axis of the auger blade to move toward a true vertical position about its transverse pivotal axis and against the bias of the springs whereby a vertical hole is assured. Upon removal of the auger from the hole, the springs serve to return the auger to its adjusted, slightly rearwardly inclined, position whereby the auger is ready to dig another vertical hole.

6 Claims, 3 Drawing Figures

FIG. 1
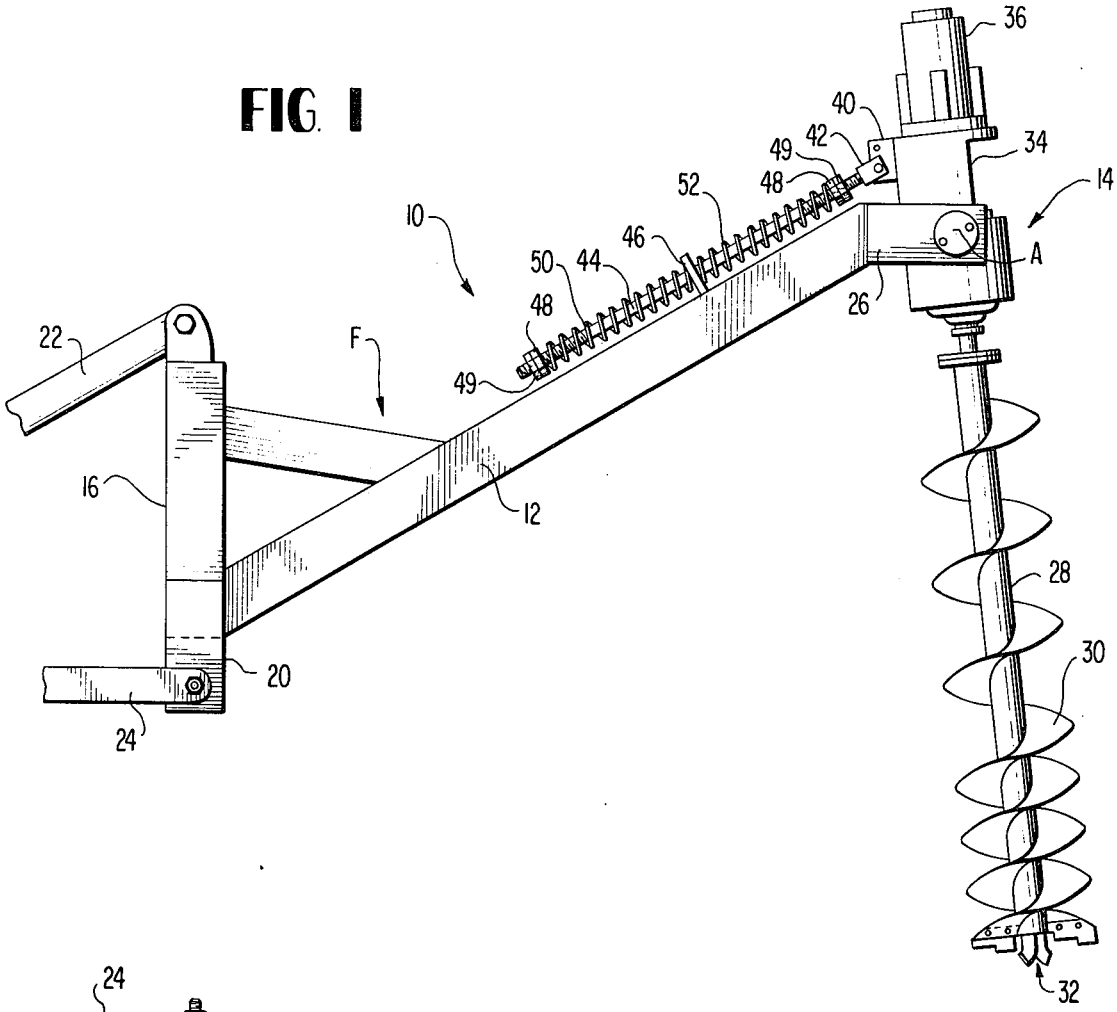
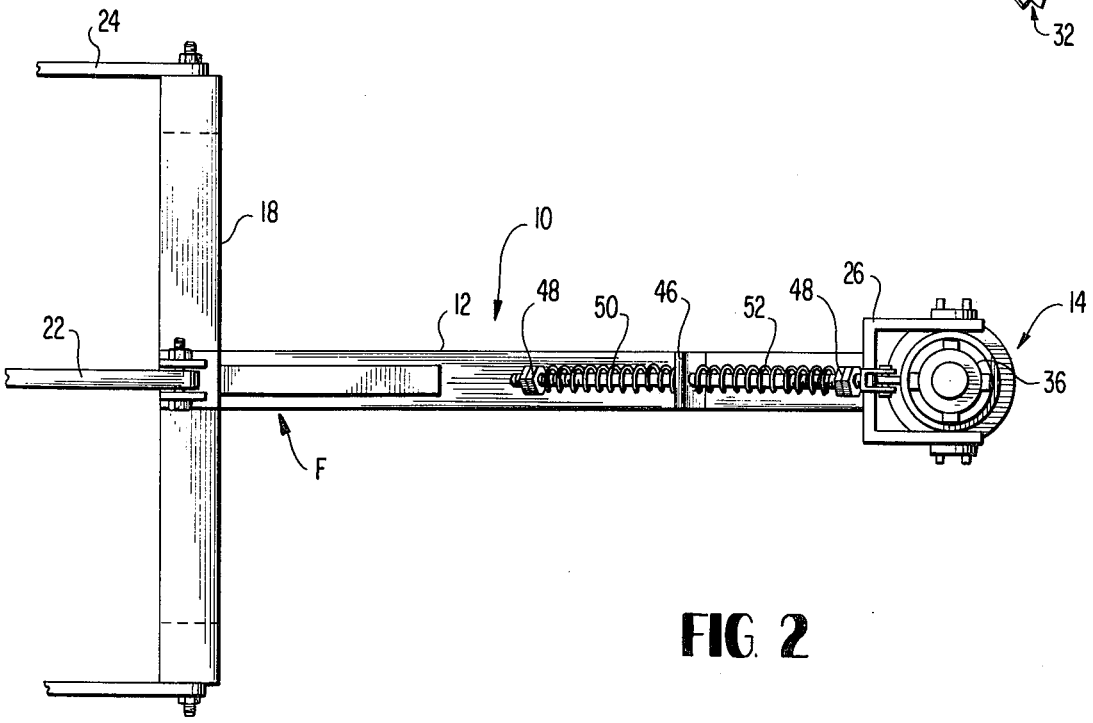
FIG. 2

DIGGER ATTACHMENT

The present invention relates to a digger attachment for a tractor and particularly relates to a novel and improved auger for drilling vertical holes in the ground.

Many and various types of post-hole diggers have been proposed and constructed in the past for use as attachments to a tractor. Generally, such diggers comprise an auger freely pivoted at the rear end of a frame, the opposite forward end of which is pivotally secured to the tractor. By pivoting the frame downwardly, the auger drills the hole. It will be appreciated, however, that as the frame pivots downwardly, the pivot point of the auger and the frame arm prescibes a rearwardly extending arc. This tends to incline the rotational axis of the auger toward the tractor as the hole is dug and results in the formation of a slanted or canted holes.

To avoid this problem, auger attachments for tractors have been provided with a forwardly projecting handle whereby the operator can reach back from the tractor seat and, by manipulating the handle, locate the point of the auger slightly rearwardly of the vertical through the pivotal mount for the auger. In this manner, the auger is initially inclined rearwardly and, as the frame arm is pivoted downwardly to dig the hole, the auger pivots forwardly toward a true vertical position whereby a substantially straight hole can be dug. Alternately, and with the auger freely pivotally suspended from the end of the frame arm, the tractor can be rolled ahead as the frame arm is pivoted downwardly, thus maintaining the rotational axis of the auger in a relatively vertical position while digging. This movement of the tractor, however, is somewhat difficult to accomplish in the precise manner necessary to achieve a true vertical hole and very often the tractor would be moved ahead too little or too far frequently causing damage to the auger and its attachment frame and, at best, forming only an approximately vertical hole. Various devices for maintaining an auger substantially vertical during boring are disclosed in U.S. Pat. Nos. 2,320,775; 2,461,373; 3,493,261; 3,351,151; and 3,604,521.

The present invention provides a digger attachment for tractors which eliminates or minimizes the foregoing and other problems associated with prior digger attachments for tractors, such as exemplified in the foregoing patents, and provides a novel and improved digger attachment for tractors having various advantages in construction, mode of operation, and result in comparison with such prior digger attachments. Particularly, the present invention provides a novel and improved digger for attachment to a tractor including a frame having an elongated arm with a three-point mounting hitch at its forward end for releasable securement to the tractor. At the rear end of the inclined frame arm, an auger is pivotally mounted for movement about a transverse axis. The auger includes a head which mounts a hydraulic motor for rotating the depending auger screw. As is conventional, the frame arm is inclined upwardly in a rearward direction and is pivoted downwardly. While boring the transverse pivot axis of the auger prescribes an arc which tends to incline the auger forwardly toward the tractor resulting in a slanted hole. In accordance with the present invention, the auger is provided with a mechanism for initially disposing the auger such that the rotational axis of the screw is initially slightly inclined rearwardly of the vertical through the transverse pivotal axis of the auger.

Thus, with the tip of the auger displaced rearwardly from the intersection of the true vertical through the transverse pivotal axis of the auger and the ground, the downward pivotal movement of the frame rotates the auger about its pivotal mounting as the hole is bored, the auger obtaining a substantially true vertical position substantially about the time the hole is completely formed. Consequently, a true vertical hole is formed.

To accomplish the foregoing, a shaft is pivotally mounted to the head of the auger above its transverse pivot and extends forwardly toward the tractor generally parallel to the frame arm and freely through a bracket secured to the frame arm. A pair of coil springs are disposed about the shaft on opposite sides of the bracket, the near ends of the springs bearing against the bracket while their opposite ends bear against nuts screwthreaded adjacent opposite ends of the shaft. By threading and hence displacing the nuts in one direction along the shaft, one spring is compressed while the other is relieved, thereby displacing the shaft relative to the bracket. The movement of the shaft cants or inclines the auger into a predetermined angular position relative to a true vertical through its transverse pivot. By rotating the adjusting nuts more or less, the rotational axis of the auger can be inclined into selected adjusted positions relative to the true vertical through the pivotal mounting of the auger on the frame arm. Thus, the auger is spring biased into an initially inclined position wherein the tip of the auger engages the ground surface at a location slightly rearwardly, i.e. about 3 inches, of the intersection of the vertical through the transverse pivotal mounting between the auger and frame arm and the ground. As the frame arm pivots downwardly, the auger rotates about its transverse pivot against the bias of the springs into a true vertical position very nearly at the time the hole is completely formed, the auger thus forming a substantially true vertical hole. Upon removal of the auger from the hole, it will be appreciated that the springs also pivot the auger back to its initially inclined position relative to the vertical whereby a subsequent hole can be bored with like assurance that the resulting hole will be a true vertical. Thus, by using the auger of the present invention, the auger need not be adjusted by the operator or the tractor displaced forwardly each time a new hole is formed since the auger automatically returns to its preset angular inclination whereby repeated formation of subsequent vertical holes is guaranteed.

Accordingly, it is a primary object of the present invention to provide a novel and improved digger attachment for a tractor for forming substantially vertical holes.

It is another object of the present invention to provide a novel and improved digger attachment for tractors wherein the formation of substantially vertical holes is accomplished repeatedly without adjustment by the operator when boring successive holes.

It is still another object of the present invention to provide a novel and improved auger type digger attachment for tractors wherein the auger is readily disposed in one of selected adjustable angular positions relative to the vertical in accordance with the depth of the hole to be dug whereby substantially vertical holes are achieved irrespective of such depth.

It is a further object of the present invention to provide a novel and improved digger attachment for tractors having the foregoing characteristics and which is completely compatible with existing tractors, relatively inexpensive to manufacture, and can be readily and easily adapted to existing digger attachments. These and further objects and advantages of the present invention will become more apparent upon reference to the following specification, appended claims and drawings wherein:

FIG. 1 is a fragmentary side elevational view of an improved attachment constructed in accordance with the present invention;

FIG. 2 is a plan view thereof; and

Figure 3:
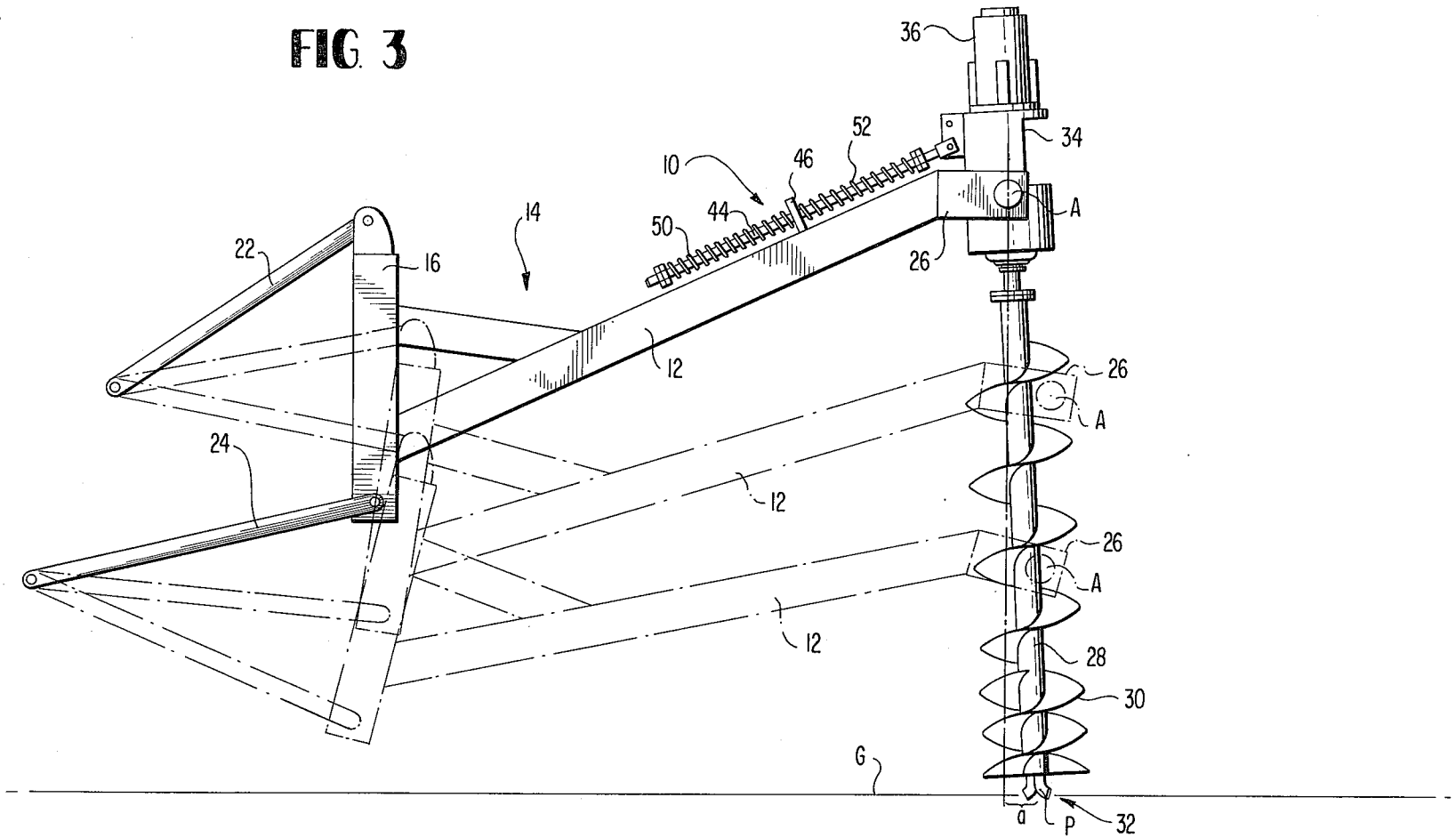

FIG. 3 is a view similar to FIG. 1 illustrating the auger in initial position, and the frame arm supporting the auger in various positions as the auger bores the hole in the ground. Referring now to the drawings, particularly to FIGS. 1 and 2, there is illustrated a digger attachment generally designated 10 constructed in accordance with the present invention and including a frame, also generally designated F, having an elongated inclined arm 12 having at its forward end a three-point mount for attachment of the digger to a tractor, not shown, and at its rear end a pivotally mounted auger generally designated 14. The three-point mount at the forward end of the frame arm 12 includes a central vertically extending support 16 connected to and medially of a generally horizontally extending support 18 which terminates in depending legs 20 at its opposite ends, the forward end of frame arm 12 being suitably connected as by welding to the horizontal arm 18. The upper end of upright support 18 and the lower ends of the leg 20 are pivotally connected to arms 22 and 24 which, in turn, are pivotally connected to the tractor and which arms 22 and 24 may be raised and lowered by conventional apparatus, not shown, carried by the tractor.

At the opposite end of frame arm 12, there is provided a yoke 26 which pivotally mounts auger 14 for pivotal movement about a transverse axis A. Auger 14 includes a depending shaft 28 with helical or screw type blades 30 thereabout terminating at its lower end in an auger bit generally designated 32. Shaft 28 is rotatably mounted at its upper end in a housing 34 and is driven by a hydraulic motor 36 mounted on top of housing 34. Suitable hydraulic lines, not shown, are connected between motor 36 and a source of fluid under pressure carried by the tractor, also not shown. Hydraulic motor 36 may be any suitable commercial motor and a preferred commercial hydraulic motor is a Char-Lynn No. 305 Hydraulic Orbit Motor manufactured by Eaton Corporation. It will be appreciated that auger 14 and the drive thereof does not, per se, form part of the present invention, that other commercially available augers may be utilized in the present invention, and that further detailed description of auger 14 and its drive 36 is not therefore believed necessary.

In order to form a substantially true vertical hole utilizing the digger attachment 10 hereof, auger 14 is mounted on frame F in a manner enabling initial inclination of the auger relative to frame F such that the axis of the auger shaft 28 can be slightly inclined rearwardly relative to a true vertical passing through the transverse pivotal axis A of yoke 26 before boring is commenced. Also, auger 14 is mounted on frame F for pivotal movement about its transverse axis A when boring from its initial position with the auger shaft axis inclined to the true vertical to a position with the auger shaft axis substantially coincident with the true vertical. To accomplish the foregoing, there is provided a bracket 40 on the forward side of housing 34. A clevis 42, suitably secured to one end of a shaft 44, is pivotally secured to bracket 40. Shaft 44 is threaded at its opposite ends and passes through an opening in a bracket 46 upstanding from and secured to the upper side of frame arm 12. A pair of nuts 48 are threadably received about the opposite ends of shaft 44 and engage remote ends of a pair of coil springs 50 and 52 disposed about shaft 44 on opposite sides of bracket 46. Lock nuts 49 may also be utilized as desired. The near ends of springs 50 and 52 engage opposite sides of bracket 46. Shaft 44 is axially movable through bracket 46 and it will be appreciated that axial displacement of shaft 44 in opposite directions inclines or pivots auger 14 about its transverse pivotal axis A in opposite directions respectively.

To incline the auger about its transverse pivotal axis A, the nut 48 and its lock nut 49 at one end of shaft 44 can be threaded to compress the spring between such nuts and bracket 46 while the nuts at opposite end of the shaft can be unthreaded to relieve the spring between it and bracket 46. Consequently the spring forces acting on the nuts, when threaded and unthreaded as aforedescribed, become unbalanced and the springs tend therefore to axially displace the shaft in a predetermined direction until the spring forces balance one another.

In use, digger attachment 10 is disposed in its elevated position, as illustrated in full line in FIG. 3, and drawn to the site of the hole. With the auger 14 elevated above the ground, the nuts on the shaft 44 are adjusted to set a predetermined inclination of the auger in a rearward direction such that the tip 32 of auger 14, when in initial contact with the ground indicated G, is spaced a horizontal distance, indicated *a* in FIG. 3, approximately 3 inches from a true vertical extending through its transverse pivotal axis A. For example, if auger 14 is initially disposed with the axis of auger shaft 28 substantially coincident with the true vertical, the lower nuts 48 and 49 are threaded about shaft 44 to compress spring 50 while the upper nuts 48 and 49 are unthreaded to relieve spring 52 whereby the compressed spring 50 will urge the lower nuts forwardly and consequently axially displace shaft 44 in a generally forward direction causing auger 14 to pivot about its transverse axis A in a generally counterclockwise direction as seen in FIG. 3. The pivotal movement of the auger terminates in an adjusted inclination when the spring forces balance one another and it will be appreciated that a selected inclination of the auger can be obtained by selected threading and unthreading action of the nuts to a greater or lesser extent as necessary whereby the nuts are adjusted such that the auger tip is spaced a predetermined distance *a* from the true vertical.

With the nuts thus set and locked and the auger inclined rearwardly, motor 36 is actuated to rotate the auger. The digger attachment is then lowered and the auger bores the hole. As the attachment is lowered as illustrated by the sequence of full and dashed lines in FIG. 3, it will be appreciated that the transverse pivotal axis A of auger 14 moves in a rearward direction along the arc of a curve such that the distance between the true vertical through the pivotal axis A and the initial penetration point P of the auger at ground level diminishes. The digger attachment and its linkage with the tractor are such that the transverse axis A will continue to move rearwardly past or beyond a true vertical through the initial point of penetration of the auger in the ground and then move forwardly such that when the auger reaches final penetration, the axis through the auger and a vertical through the initial point of penetration P are substantially coincident. That is, as the digger attachment is lowered, the transverse pivotal axis A transcribes an arc as it moves from its upper position shown by the full lines in FIG. 3 to its lowermost position shown by the lower dashed lines in FIG. 3. This arc at first lies on one side of a true vertical through the point of initial penetration P and then shifts rearwardly to the opposite side of such true vertical and then forwardly again to a point, at the time the auger obtains final penetration, where a true vertical line through axis A lies substantially coincident with the true vertical through the initial point of penetration P.

When the hole is bored in the manner described above, it will be appreciated that a substantially true vertical hole is obtained. Also, it will be noted that, as frame arm 12 is lowered, the inclination of the auger relative to the true vertical changes against the bias of the springs. Thus, the lower spring 50 will be compressed and the upper spring 52 will be relieved at the time the auger obtains a substantial coincidence with the true vertical. Consequently, when the auger is withdrawn from the hole, the unbalanced springs axially displace shaft 44 and return the auger to its initially predetermined inclined position as illustrated in FIG. 1. The auger is thus automatically returned to its initially inclined position ready to bore another hole.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description, and all changes which come within the meaning and range of equivalency of the claims are therefore intended to be embraced therein.

What is claimed and desired to be secured by United States Letters Patent is:

1. A digger attachment for a tractor comprising a frame including an elongated arm, an auger carried by said frame arm adjacent one end thereof and for pivotal movement about a transverse pivotal axis, said auger having a rotatable shaft carrying a blade, means carried by said frame adjacent the opposite end thereof for securing the frame to the tractor for movement of said arm between a raised position with said auger blade poised for initial penetration into the ground and a lowered position with the auger blade penetrating the ground to a predetermined depth respectively, and means cooperable between said frame arm and said auger for biasing said auger for movement into a first angular position relative to said arm such that, when said arm lies in its raised position, the rotational axis of said auger blade is slightly inclined from a true vertical line through its transverse pivotal axis with the auger blade tip located on the side of said true vertical line remote from said securing means, said auger being pivotal about its transverse axis and against said biasing means when said arm is moved from said raised position to said lowered position such that the rotational axis of said auger blade is substantially parallel to said true vertical line when said arm lies in said lowered position, said biasing means including a shaft pivotally carried by one of said auger and said arm and an abutment carried by each of said shaft and the other of said auger and said arm, and a spring about said shaft between said abutment for biasing said auger into said predetermined angular position relative to said arm, an extended portion of said shaft extending freely through one of the abutments, a third abutment carried by said shaft and a spring about the extended shaft portion between said one abutment and said third abutment, said springs cooperating with said abutments to bias said auger into said first angular position.

2. An attachment according to claim 1 further comprising means for adjusting the spring force for adjusting the angular position of said auger relative to said frame arm.

3. An attachment according to claim 2 wherein said adjusting means includes means for axially displacing said second abutment relative to said shaft.

4. A digger attachment for a tractor comprising a frame including an arm, means at one end of said arm for securing said frame to a tractor, an auger having a rotatable auger blade and carried by said frame adjacent the opposite end of said arm for pivotal movement about a transverse axis normal to the rotational axis of said auger blade, said auger being pivotal about said transverse axis between a first angular position wherein the axis of rotation of said blade forms an acute angle with a vertical line normal to and through said transverse axis and a second angular position wherein the axis of rotation of said blade lies substantially parallel to said vertical line, and means cooperable between said auger and said frame arm for biasing said auger for pivotal movement from said first angular position into said second angular position, said biasing means including a shaft pivotally carried by one of said auger and said arm and an abutment carried by each of said shaft and the other of said auger and said arm, and a spring about said shaft between said abutment for biasing said auger into said predetermined angular position relative to said arm, an extended portion of said shaft extending freely through one of the abutments, a third abutment carried by said shaft and a spring about the extended shaft portion between said one abutment and said third abutment, said spring cooperating with said abutment to bias said auger into said first angular position.

5. An attachment according to claim 4 further comprising means for adjusting the spring force for adjusting the angular position of said auger relative to said frame arm.

6. An attachment according to claim 5 wherein said adjusting means includes means for axially displacing said second abutment relative to said shaft.

* * * * *